US005501617A

United States Patent [19]

Arnett

[11] Patent Number: 5,501,617

[45] Date of Patent: Mar. 26, 1996

[54] INSULATION DISPLACEMENT CONNECTOR INSERTION CAP

[75] Inventor: Jaime R. Arnett, Fishers, Ind.

[73] Assignee: AT&T Corp., Murray Hill, N.J.

[21] Appl. No.: 329,671

[22] Filed: Oct. 31, 1994

[51] Int. Cl.[6] ..... H01R 23/02

[52] U.S. Cl. ..... 439/676; 439/417; 439/404

[58] Field of Search ..... 439/395, 404, 439/405, 417, 676

[56] References Cited

U.S. PATENT DOCUMENTS

| | | | |
|---|---|---|---|
| 3,910,672 | 10/1975 | Frantz | 439/417 |
| 5,091,826 | 2/1992 | Arnett et al. | 439/404 |
| 5,096,442 | 3/1992 | Arnett et al. | 439/676 |
| 5,118,310 | 6/1992 | Stroede et al. | 439/405 |
| 5,186,647 | 2/1993 | Denkmann et al. | 439/395 |
| 5,228,872 | 7/1993 | Liu | 439/404 |

*Primary Examiner*—David L. Pirlot
*Assistant Examiner*—Jill Demello

[57] ABSTRACT

An insertion cap for inserting and connecting wires in an insulation displacement type of connector has a roof-shaped upper member and depending side walls. Slotted ribs extend between the sidewalls for driving the wires being connected down into the slots formed by bifurcated fingers in the connector. The upper surface of the upper member has slots or other impact tool locating means for holding the impact tool in place while it delivers an impact to the cap, driving it and the ribs downward into the connector. The slot or slots are so positioned that the cap does not cant or flip when the impact is delivered thereto.

10 Claims, 4 Drawing Sheets

FIG. 7
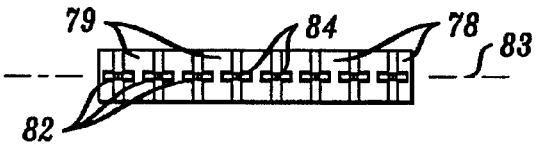
FIG. 6
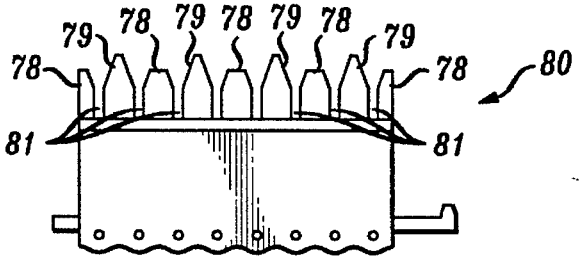
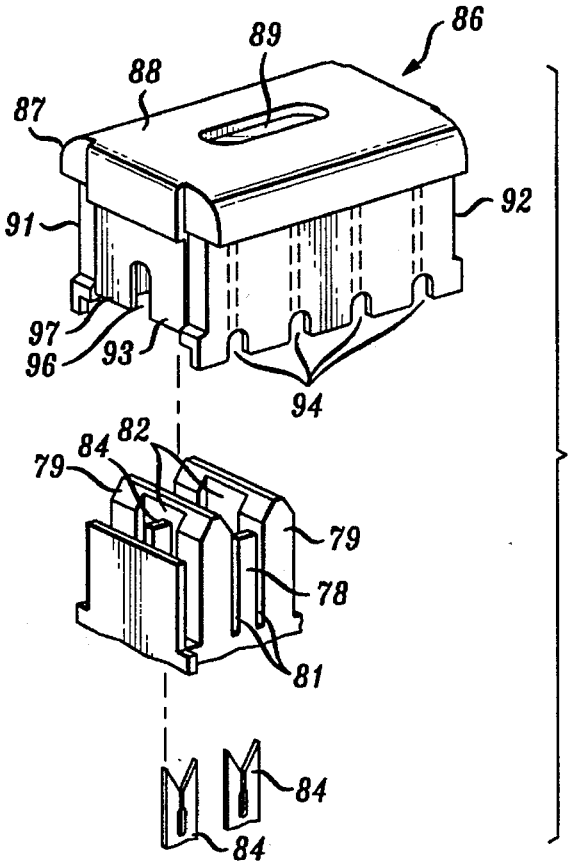
FIG. 8
FIG. 9
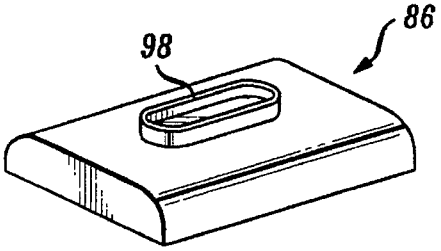
FIG. 10
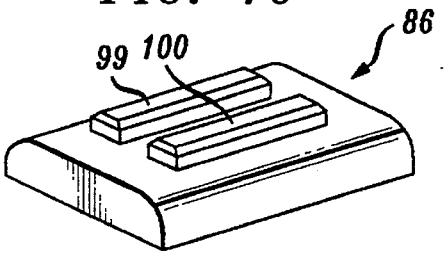

INSULATION DISPLACEMENT CONNECTOR INSERTION CAP

FIELD OF INVENTION

This invention relates to electrical connectors intended primarily for use electrical communication equipment and, more particularly, to the means by which connectors of the insulation displacement type are wired.

BACKGROUND OF THE INVENTION

Electrical connectors for use, for example, in telephone installations, generally comprise a wired connector, a jack frame attached thereto, and a modular plug attached to the end of the telephone wires, for example, insertable into the jack frame electrical connection to the connector. Such a connector is shown and described in U.S. Pat. No. 5,096,442 of Arnett et al. and is herewith incorporated by reference in this specification.

The insulation displacement connector as shown in Arnett et al. patent comprises, in detail, a connector member having a plurality of fiat elongated wires which are the connecting terminals for the assembly. The fiat wires are each connected to insulation displacement connectors, each of which has a pair of opposed bifurcated contact fingers into each one of which the insulated wires leading to the connector is inserted. The bifurcadon cuts through the insulation on the wire and makes both electrical and mechanical contact therewith, thereby holding the wire firmly in place. In addition, the connector has a row of wire receiving slots on each side of the centerline of the connectors which allow the wires to be driven down into the bifurcated slot. A dielectric cover surrounds the jack frame and connector assembly both for electrical insulation and physical support. The jack frame and the modular plug, together with the insulation displacement connector, form a standard modular jack which meets the requirement of the FCC Registration Rules. Up to six such modular jack arrangements may be mounted in a single conventional wall plate and fit into a "gangable single device box" such as is specified in Publication 051 of the National Electrical Manufacturers' Association (NEMA).

One such standard type connector, as shown in the aforementioned Arnett et al. patent, has provision for eight leads into the connector, each of which has to be inserted into a corresponding bifurcated contact. Thus, the installer of a single wall plate having provision for six modular connectors must make forty-eight such connections. In the case of a newly constructed building, for example, several hundred such plates may have to be installed, thus a single telephone wiring installer may be called upon to make several thousand such individual connections. Where the entire process is performed by hand, the fatigue factor is daunting. As a consequence, there have been numerous attempts in the prior art to reduce the amount of manual labor involved in making the connections to the modular jack. One device for accomplishing this is an insertion cap which is designed to force the leads to be connected down into the bifurcated connector when the installer fits the cap over the connector portion of the modular jack and presses down. Such an insertion cap generally connects four such leads by forcing them into their respective bifurcated insulation displacement fingers, thus two insertion caps are required for each modular connector. As a consequence, the manual labor, and primarily the exertion of pressure by the installer, is reduced by as much as a factor of four. However, in a large installation, the installer must still do an intolerably large number of such operations and consequently, is still subject to fatigue. There have been insertion caps capable of making more than four insulation displacement connections simultaneously but which still require the exertion of pressure by the installer.

One prior art arrangement that relieves the installer from having to exert as much pressure on his part is an impact tool which is used to drive each wire in turn into its corresponding bifurcated connector slot. The use of such a tool permits the installer to pretrim the leads to their proper length and then to drive them into their corresponding slot with one actuation of the impact tool per lead. The tool impacts the wire only once per actuation, and in the hands of a skillful installer, its use materially reduces the manual effort on the part of the installer and the time involved to complete each modular connector. When the impact tool is used, the insertion cap is not necessary, however, it may be used to hold the wires in place after connection is made, or to protect the connections.

It has also been proposed that simple pliers be used to force the insertion caps into place, driving the leads down into the bifurcated fingers. Such use of a pair of pliers still necessitates the exertion of force by the installer, hence, it is not a complete answer to the fatigue problem. In addition, where the connector is already mounted to the plate, as will often be the case, pliers cannot be used because of the lack of available space in which to manipulate them. On the other hand, the impact tool can be used.

Another often attempted solution to the connection problem has involved the complete redesign of the modular connector, at least that portion thereof that involves connecting the several leads into the connector portion of the jack. Such redesigns have met with varying degrees of success, but the very operation of re-designing entails engineering expense, added manufacturing expense, and obtaining approval from the various governmental bodies involved. It is preferable that a solution be found that does not require any alteration of the standard modular connector, that relieves the installer of a large portion of any manual installation steps, and that materially reduces the time involved in completely wiring and installing a modular connector.

SUMMARY OF THE INVENTION

The principles of the present invention are applicable to a number of connector configurations and are aimed at solving or reducing the twin problems of installer fatigue and installation time. These principles and features of the invention are demonstrated as applied to a standard modular connector as shown in the aforementioned Arnett et al. patent.

In a first illustrative embodiment of the invention, the invention comprises an insertion cap having a roof-shaped upper surface and eight slotted ribs depending from the underside thereof, the slots in each rib being positioned to straddle a pair of bifurcated insulation displacing fingers and the ribs being so spaced as to pass into the wire containing slots in the connector portion to drive each lead into its respective slot and into the bifurcated fingers. The ribs are arranged in co-linear pairs across the width of the underside of the cap so that the centerlines of the slots in each of the pairs are spaced the same distance as the oppositely oriented pairs of bifurcated fingers. Thus, when the cap is placed over the connector portion and pressed downward, the ribs drive the wires down into the bifurcated fingers and the slots in the ribs, by straddling the fingers, allow the leads to be pressed well down into their respective bifurcations.

The roof-shaped upper surface has first and second longitudinally extending slots therein which are oriented at right angles to the pairs of co-linear ribs. The slots are sized to receive the impact bit No. 110 of a D Impact Tool such as produced by Harris-Dracon, Inc., and do not extend through the cap, thereby having a floor against which the tool bit bears. When the cap is positioned over the connector portion of the modular connector with the bit in or above a slot, actuating the tool causes it to deliver one downward driving blow to the cap. When the floor of the second slot is likewise struck by the tool, the cap is generally completely driven into place and connection is made to the eight leads. The dimensions of the slots are such that the tool bit is prevented from slipping prior to or during impact. The placement and spacing of the slots is of considerable importance inasmuch as an improperly positioned impact point can cause the cap to be canted and jammed, which can lead to faulty connections, or the entire connector can flip over upon impact. Thus, it is necessary that the slots be longitudinally centered and spaced from each other a distance equal to or less than the spacing of the oppositely opposed bifurcated fingers. Such a spacing substantially reduces or eliminates any tendency of the cap to rock or become canted. Each slot is also located so that its longitudinal centerline lies in a plane parallel to and between the rows of wire receiving slots in the connector.

In a second illustrative embodiment of the invention, the upper surface of the cap has a built up slot for receiving the bit of the impact tool, while in a third embodiment, instead of a slot, first and second ridges are formed on the upper surface with a spacing slightly greater than the thickness of the impact tool bit.

In still another embodiment of the invention, a linear type connector, such as the Western Electric 110C-4, has one or more insertion caps, each having an impact tool receiving slot centered above and between the bifurcated fingers.

In all of the illustrative embodiments of the invention, the location of the impact of the tool bit is important to insure proper seating of the insertion cap. With the arrangement of the invention, the manual effort expended by the installer, and hence, fatigue, are minimized, while accurate complete connection is assured in a minimum of connection time.

DESCRIPTION OF THE DRAWINGS

FIG. 6 is an elevation view of a part of a Series 110C-4 type connector;

FIG. 7 is a plan view of the top of the connector of FIG. 6;

FIG. 8 is an exploded perspective view of the connector of FIGS. 6 and 7 and of the insertion cap of the invention for use therewith;

FIG. 9 is a perspective view of a portion of the insertion cap of FIG. 8 showing an alternative configuration of the impact tool bit receiving means; and FIG. 10 is a perspective view of a portion of the insertion cap of FIG. 8 showing a second alternative configuration of the impact tool bit receiving means.

DETAILED DESCRIPTION

Figure 1:
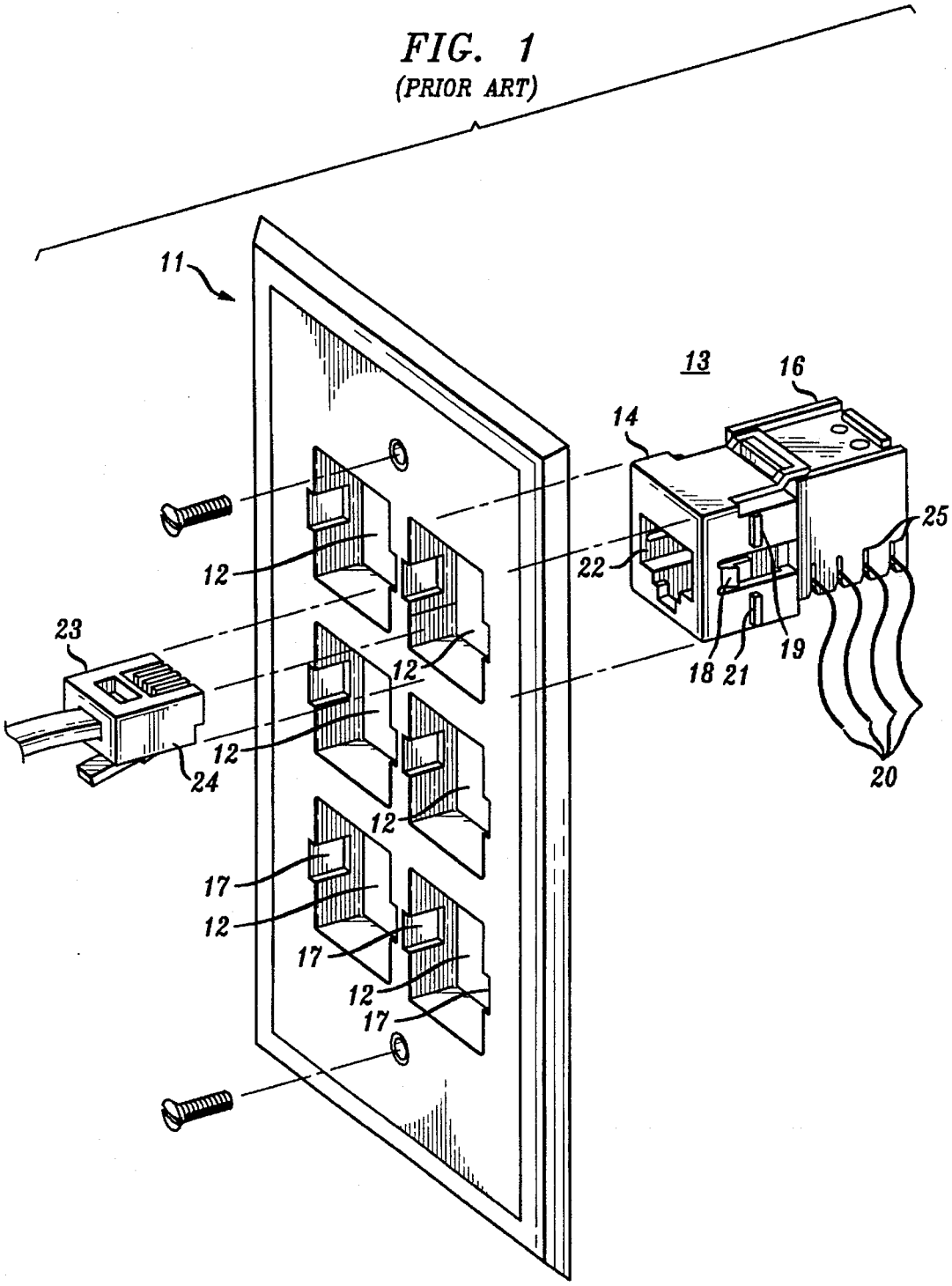
FIG. 1 (PRIOR ART)
FIG. 1 is an exploded perspective view of an M-Series type connector and a wall plate mounting therefor.

In FIG. 1 there is shown a conventional and standard wall plate 11 having openings 12 therein for receiving six modular jacks or connectors 13, one of which is shown. Each jack comprises a jack frame 14 and a connector member 16. The modular jacks 13 fit into a "gangable single device box" such as is specified in Publication OS-1 of the National Electric Manufacturers Association (NEMA) and is commonly referred to as an M Series connector jack. The NEMA box, not shown, is normally positioned directly behind the wall plate 11. Each of the openings 12 in wall plate 11 is sized to receive jack frame 14 and includes slots. 17 on opposite sides thereof for interlocking with flexible tabs 18, only one of which is shown, on jack frame 14. Jack frame 14 has stop members 19 and 21, on each side thereof, which prevent jack frame 14 from being pushed all of the way through opening 12. Thus, after insertion of jack frame 14 into opening 12, it is firmly held in place therein by means of tabs 18 and stop members 19 and 21. Insertable into an opening 22 in jack frame 14 is a modular plug 23 which is attached and electrically connected to cable 24 which, in turn, leads to the piece of communications equipment, not shown, to which and from which electrical signals are to be transmitted via connector member 13.

Inserted into the rear or back side of jack frame 14 is electrical connector member 16. Wires 20 are pressed into slots 25 on each side of connector member 16. The wires 20 may be insulated or bare, and are shown in FIG. 1 merely for illustrative purposes. In actuality, as will be seen and explained more fully in connection with FIG. 2, the wires enter into connector member 16 from the rear thereof and are pressed into slots 25 in a manner to be explained more fully with reference to FIG. 2.

Figure 2:
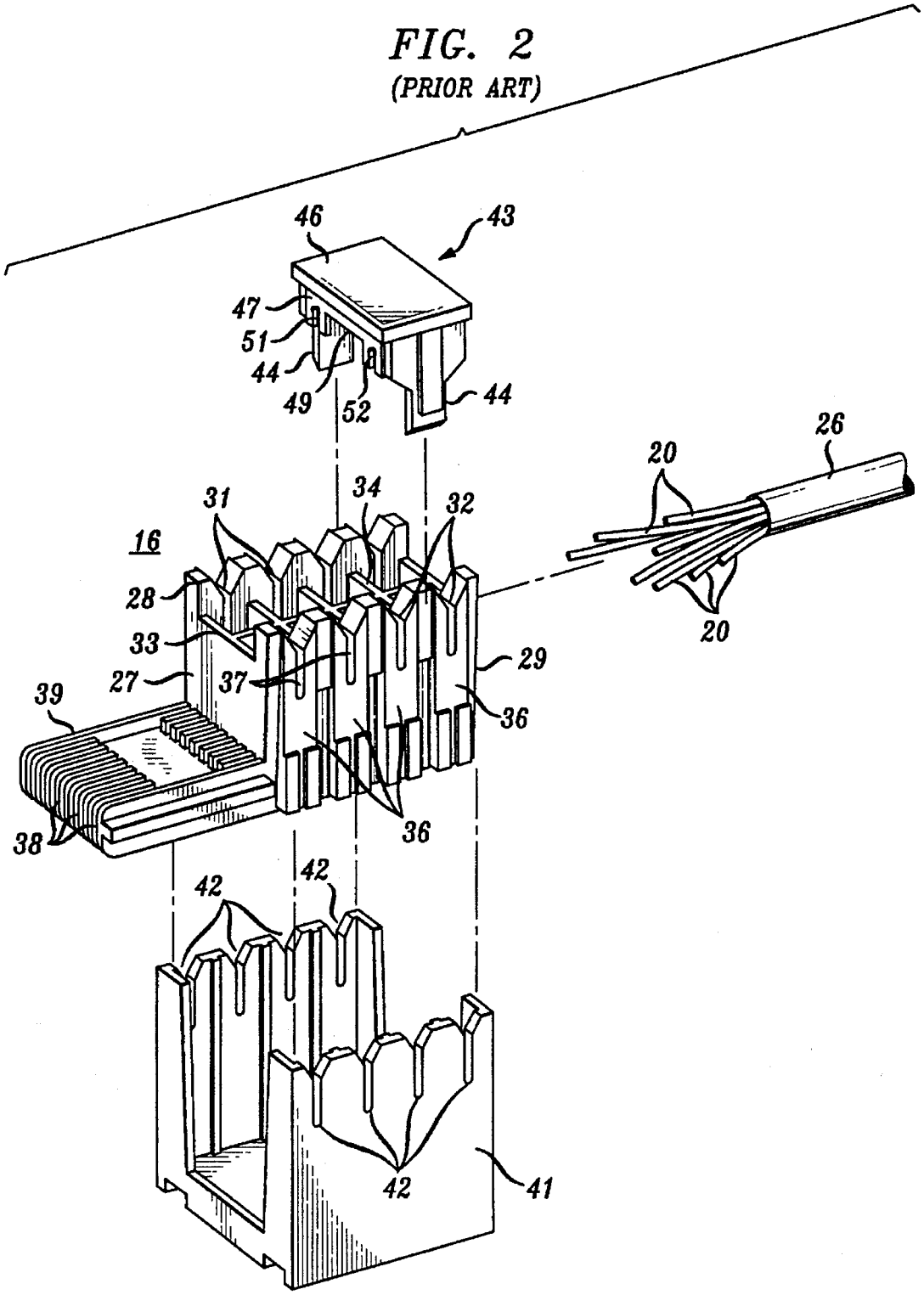
FIG. 2 (PRIOR ART)
FIG. 2 is an exploded perspective view of an M-Series type connector and a prior art wire insertion cap therefor.

FIG. 2 is an exploded perspective view of a common prior an arrangement for attaching the wires 20 shown as being carried in a cable 26 to the rear of connector member 16. In order that the insulation displacement arrangement of connector member 16 may be more clearly seen, the member 16 has been turned upside down relative to its orientation in FIG. 1. Connector member 16 comprises a spring block 27 having formed on each longitudinal side 28 and 29 thereof a plurality of wire receiving slots 31 and 32, respectively, there being four slots per side for a total of eight. In the space between side walls 28 and 29 is a centrally located longitudinal rib 33 and a plurality of spaced transverse ribs 34 which together form eight wire compartments, each compartment having a slot 31 or a slot 32 therein. Immediately adjacent each wire compartment on the exterior of side walls 28 and 29 is a metallic contact member 36, the upper end of which is bifurcated to form an insulation displacement pair of fingers. Each bifurcation slot 37 is aligned with a corresponding slot 31 or 32 in the side walls 28 and 29. The metallic contact members 36 are each individually connected to a flat contact wires 38 which is wrapped around the protrusion 39 of connector member 16 which is insertable into jack frame 14 so that the wires 38 make electrical contact with wires therein (not shown) which, in turn, make contact with the wires on modular plug 23. The assembly of connector member 16 is completed by plastic cover member 41 which fits over the spring block 27 in a snug fit. Cover member 41 has slots 42 therein which align with the slots 31 and 32 and the bifurcation slots 37.

As was discussed heretofore, the wires 20 may be inserted into the slots 31, 32, 37 and 42 individually with an impact tool (i.e., wires cannot practically be installed without a tool), with the bifurcated members 36 making electrical and mechanical contact therewith, or they may be inserted by means of insertion caps. Fig. 2 depicts a commonly used insertion cap 43. Cap 43 has finger tabs 44 on each side depending from a top plate 46 and which are spaced to space and fit snugly over cover member 41. Tabs 44 facilitate placement and removal of cap 43 and also function to prevent, at least to some extent, rocking or canting of cap 43 when:pressure is applied thereto. Also depending from top plate 46 are substantially identical front and rear flanges 47 only front flange 47 being shown. The flanges 47 each has a central recess 49 to provide clearance for the wires extending through the spring block 27 from back to front between the side walls 28 and 29. Slots 51 and 52 are formed in the flanges 47 and 48 and their spacing is substantially identical to the transverse spacing of the bifurcated contact members 36. In use, the cap 43 is used to force four wires 20 down into their respective slots by means of the bottom edges of flanges 47 bearing against them. The slots 51 and 52 straddle the bifurcated contact members 36 so that the wires are pushed well down into the bifurcated slots 37. As was discussed hereinbefore, two insertion caps 43 are required to connect eight wires 20 to connector member 16, and the caps are generally inserted manually. Thus, both elapsed time and installer fatigue are lessened, but not, in the case of fatigue, eliminated.

Figure 3:
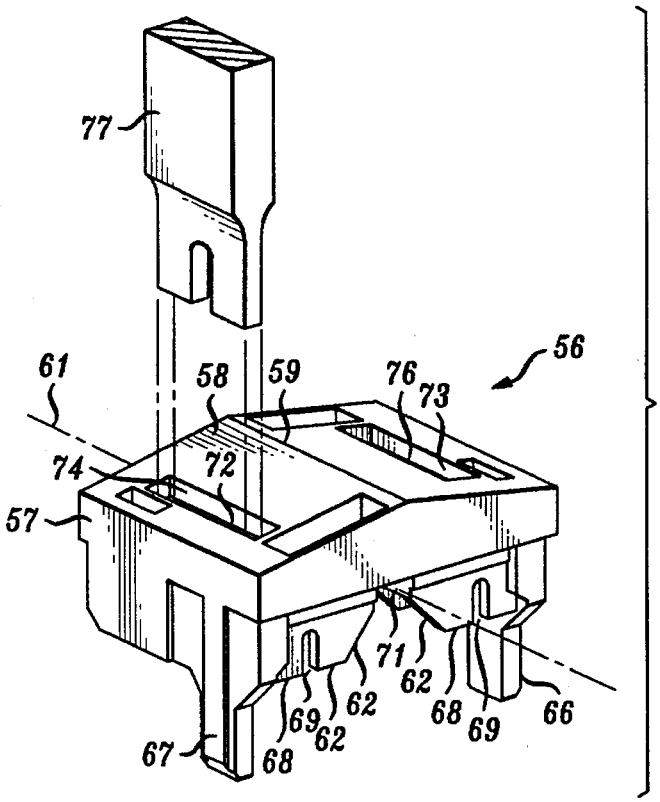
FIG. 3 is a first perspective view of the insertion cap of the invention.
Figure 4:
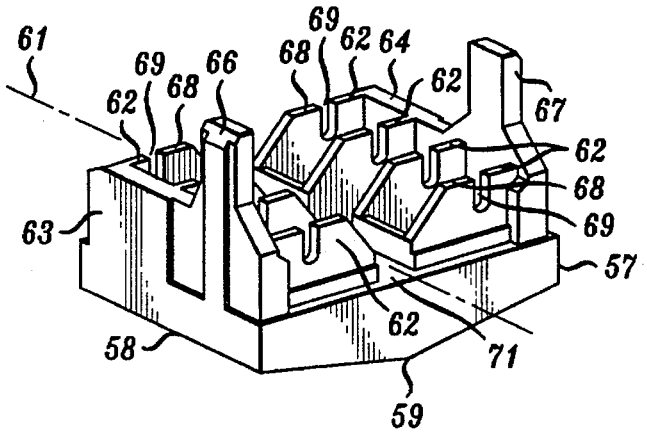
FIG. 4 is a second perspective view of the cap of FIG. 3, inverted to show, in perspective, the underside thereof.

In FIG. 3 there is shown a perspective view of the insertion cap 56 of the present invention in a preferred embodiment thereof. Cap 56 comprises an upper member 57 having an angled or roof-shaped upper surface 58 with the peak 59 thereof being parallel to and in the same plane as the centerline 61 of the cap 56. Depending from the underside of member 57 are a plurality of ribs 62 which are best seen in FIG. 4. As will be apparent hereinafter, for the M-Series modular connector, there are four such ribs 62 on either side of the centerline 61 of cap 56, also best seen in FIG. 4, which is an inverted view of the cap 56 of FIG. 3. The ribs extend from either side of the cap 56 as defined by side walls 63 and 64. A pair of depending legs 66 and 67 extend from the underside of cap 56 to facilitate emplacement and removal of the cap on the connector 16. Each of the ribs 62 has a bottom edge 68 which has an elongated slot 69 therein. Slot 69 performs the same function as the slots 51 and 52 of prior art cap 48, i.e., it straddles the bifurcated fingers so that ribs 62 can be pushed down sufficient for the bottom edges 68 to force the wires well into the bifurcation. As best seen in FIG. 4, the ribs 62 extend from the side walls 63 and 64 toward the center of the cap, but they do not meet, thereby leaving a center passage 71 to allow passage of the wires 20.

On the top surface 58 of cap 56, as best seen in FIG. 3, there are two parallel slots 72 and 73 formed, each having a floor 74 and 76, respectively, for receiving and centering the bit 77 of an impact tool. When the cap is centered properly on the connector, the impact tool bit 77 is inserted successively into slots 72 and 73 and triggered to deliver a downward impulse or blow to the cap sufficient to drive it down on the connector, thereby driving the wires 20 into the slot between the bifurcated fingers.

Figure 5:
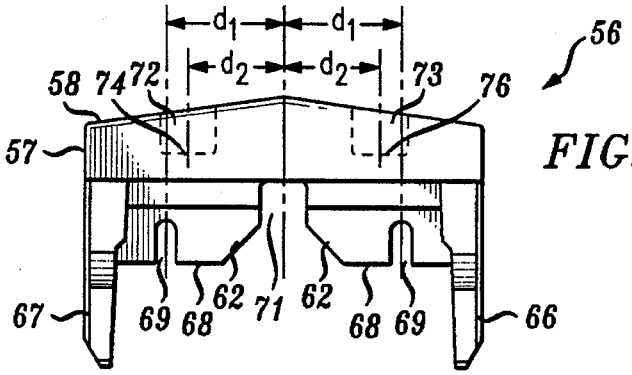
FIG. 5 is a front elevation view of the cap of the invention.

The impact delivered by the impact tool, which is a part of the installer's tool kit, can be adjusted to deliver the correct force without damage to the cap or wires. However, the location of the delivered impact is important. If the impact is too far removed from the centerline of the cap, the cap can, upon being impacted, become canted and jammed, necessitating its removal and the re-initiation of the wire connecting operation. It is also possible for the impact to cause the entire connector to flip over where it is not already connected in place in the wall plate. In either case, faulty connections are a very real likelihood, and inordinate amounts of time can be spent performing what is essentially a simple operation. The cap 56 of the present invention is designed to prevent the canting of the cap or flipping of the connector and to insure that one impact in each slot will provide proper connections, as well as insuring that the tool does not slip. In FIG. 5, there is shown the means by which these problems are overcome and good connections are assured. Slots 72 and 73 are formed in upper surface 58 to extend longitudinally parallel to the longitudinal axis 61 of cap 56, with the centerlines of the two slots spaced from the centerline 61 of the cap a distance $d_2$. On the other hand, the longitudinal centerlines of the two rows slots 69 in the ribs 62 extend parallel to the centerline 61 of cap 56, and are spaced therefrom a distance $d_1$. In accordance with the present invention, the distance $d_2$ is less than the distance $d_1$, for the cap 56, preferably by approximately one-half the width of the slot, as seen in FIG. 5. This latter restriction on the difference in $d_1$, and $d_2$ represents the preferred minimum difference. If the difference between $d_1$ and $d_2$ is less than that, the danger of canting or tipping is increased. On the other hand, the difference between $d_1$ and $d_2$ can be increased by decreasing $d_2$ so that the impact from the tool bit 77 will be closer to the centerline 61 and there is little or no danger of canting or tipping. Also, any decrease in the distance $d_1$ requires a concomitant decrease in the distance $d_2$.

The cap of the invention, formed to receive and confine the tool bit not only to prevent canting or tipping, but also to prevent slippage thereof, is adaptable for use with a linear type 110C-4 connector also. In FIGS. 7 and 8 there is shown, respectively, a side elevation view, a plan view and an exploded perspective view of the 110 type connector 80. A plurality of spaced upstanding fingers 78 and 79 form a plurality of wire receiving slots 81 and a plurality of longitudinal slots 82,82 which extend along the centerline 83 of the connector. Within the slots 82 are bifurcated fingers 84 for connection to the wires.

In FIG. 8 there is shown an exploded perspective view of a portion of the connector of FIGS. 6 and 7 and the insertion cap 86 for inserting the wires into the connector for electrical and mechanical connection thereto. Cap 86 comprises a top member 87 having an upper surface 88 in which an impact tool bit receiving slot 89 is formed. Side walls 91 and 92 depend from upper member 87 and a plurality of depending ribs 93 extend therebetween. The bottom edges of side walls 91 and 92 have a plurality of recesses 94 therein which coincide with the slots 81 in the connector 80, and the ribs 93 each have a centrally located slot 96 therein, as shown, which straddle the bifurcated fingers 84. When the cap 86 is fitted over the connector and impacted by the tool bit in slot 89, the recesses 94 and the bottom edges 97 of the ribs 93 drive the wires down between the bifurcated fingers 84, making electrical and mechanical connection thereto. The bifurcated fingers 84 are arrayed along the centerline 83 of connector 80 and the slot 89 in the cap 86 is centered thereover and extends longitudinally of the cap 86. In this case, the dimension $d_1$ and $d_2$ are both equal to zero, but the center of the slot 89 is spaced equidistant from the recesses 94, thus, as is the case in the cap of FIGS. 3, 4 and 5, the impact force is directed downward between portions of the ribs that force the wires downward. With this configuration then, as is the case with the cap 56, canting and flipping is prevented. The cap 86 is shown as configured to connect four wires. It can be understood that it can be formed to connect eight wires if desired.

In both of the caps 56 and 86, the tool bit receiving slot 72,73 is cap 56 and 89 in cap 86 is centered longitudinally of the cap to prevent tipping or canting on an axis transverse to the longitudinal axis of the cap.

In FIG. 9 there is shown an alternative form of the tool bit receiver member for cap 86, which comprises a built-up slot 98, having upstanding walls, and in FIG. 10 there is shown a tool bit receiving means comprising first and second parallel spaced ridges 99 and 101, disposed on either side of the centerline of the cap for the insertion tool of FIG. 8. It is to be understood that either of the arrangements of FIGS. 9 and 10 can be applied to the cap 56 of FIGS. 3, 4 and 5, as well.

The features and principles of the invention have been demonstrated in a first illustrative embodiment of the invention and in variations thereof in other embodiments. Various modifications or other embodiments may occur to workers in the art without departure from the spirit and scope of the invention.

What is claimed is:

1. An insertion cap for use with a modular type insulation displacement connector having a centerline and a plurality of wire receiving slots arranged in spaced linear rows on either side of the centerline which contain bifurcated fingers for making connection to the wires when inserted in the slots, said insertion cap comprising:

a body having a centerline and having a top portion with a top surface and first and second depending side walls spaced a distance apart;

a plurality of rib members extending at least a portion of the distance between said side walls and spaced from each other longitudinally of the cap;

each of said ribs having a bottom edge for engaging the wires to be connected, and a slot therein for allowing the ribs to be inserted into the connector past the bifurcated fingers; and means on said cap for receiving and centering a tool bit to drive the bottom edge of said ribs past at least a portion of the bifurcated fingers, said means having a longitudinal centerline lying in a vertical plane that lies between the spaced linear rows of receiving slots.

2. An insertion cap as claimed in claim 1, wherein said means on said cap comprises a built-up walled slot member dimensioned to receive and hold the tool bit.

3. An insertion cap as claimed in claim 1, wherein said means on said cap comprises a first longitudinal slot in said top surface dimensioned to receive and hold the tool bit, said first slot having a bottom portion against which the tool bit bears in operation.

4. An insertion cap as claimed in claim 3, wherein said means on said cap includes a second longitudinal slot spaced from said first slot and said slots being located on either side of the centerline of said body, said second slot being dimensioned to receive and hold the tool bit, said second slot having a bottom portion against which the tool bit bears in operation.

5. An insertion cap as claimed in claim 4, wherein the centerline of each of said first and second longitudinal slots is spaced from the centerline of said body a distance $d_2$ and the slot in each of said ribs is spaced from the centerline of said body a distance $d_1$, where $d_1>d_2$.

6. An insertion cap as claimed in claim 5, wherein each of said first and second slots has a width sufficient to receive the tool bit, and $d_2$ is less than $d_1$, by approximately one-half of the width of one of said slots.

7. An insertion cap as claimed in claim 1, wherein said top surface of said top portion has a peaked roof shape.

8. An insertion cap as claimed in claim 7, wherein the peak of said top surface extends longitudinally of said cap parallel to the centerline of said body.

9. An insertion cap as claimed in claim 1, wherein said means on said cap comprises first and second longitudinally extending parallel ridges spaced apart a distance sufficient to receive the tool bit.

10. An insertion cap as claimed in claim 9, wherein said ridges are disposed on either side of the centerline of said body.

* * * * *